US007289086B2

(12) United States Patent
Lee

(10) Patent No.: US 7,289,086 B2
(45) Date of Patent: Oct. 30, 2007

(54) IMAGE DATA CORRECTION METHOD AND APPARATUS FOR PLASMA DISPLAY PANEL, AND PLASMA DISPLAY PANEL DEVICE HAVING THE APPARATUS

(75) Inventor: Soo-Jin Lee, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 555 days.

(21) Appl. No.: 10/779,793

(22) Filed: Feb. 18, 2004

(65) Prior Publication Data

US 2004/0212559 A1 Oct. 28, 2004

(30) Foreign Application Priority Data

Feb. 21, 2003 (KR) ..... 10-2003-0010999

(51) Int. Cl.
*G09G 3/28* (2006.01)

(52) U.S. Cl. ..... 345/60; 345/63; 345/62; 345/66; 345/65

(58) Field of Classification Search ..... 345/60, 345/63, 694, 147, 61, 67, 103, 62, 214, 66, 345/204, 65, 211; 315/169.1–169.4; 313/306, 313/309; 358/3.02
See application file for complete search history.

(56) References Cited

U.S. PATENT DOCUMENTS 5,790,095 A * 8/1998 Onodera et al. ..... 345/690
6,088,012 A * 7/2000 Shigeta et al. ..... 345/63
6,100,859 A * 8/2000 Kuriyama et al. ..... 345/60
6,104,362 A * 8/2000 Kuriyama et al. ..... 345/63
6,249,265 B1 * 6/2001 Tajima et al. ..... 345/63
6,249,268 B1 * 6/2001 Tachibana et al. ..... 345/89
6,340,961 B1 * 1/2002 Tanaka et al. ..... 345/63
6,388,678 B1 * 5/2002 Kasahara et al. ..... 345/690
6,448,947 B1 * 9/2002 Nagai ..... 345/60
6,492,964 B1 * 12/2002 Mikoshiba et al. ..... 345/60
6,661,394 B1 * 12/2003 Choi ..... 345/60
6,747,616 B2 * 6/2004 Honda et al. ..... 345/63
6,756,977 B2 * 6/2004 Ide ..... 345/212
6,924,778 B2 * 8/2005 Awamoto et al. ..... 345/60
7,075,560 B2 * 7/2006 Ohe et al. ..... 345/690
2002/0003542 A1 * 1/2002 Tanaka et al. ..... 345/581
2002/0036650 A1 * 3/2002 Kasahara et al. ..... 345/639
2002/0175908 A1 * 11/2002 Ide ..... 345/211
2002/0190925 A1 * 12/2002 Awamoto et al. ..... 345/60
2003/0058476 A1 * 3/2003 Kwon et al. ..... 358/3.02
2004/0189569 A1 * 9/2004 Ochi ..... 345/89

* cited by examiner

*Primary Examiner*—Bipin Shalwala
*Assistant Examiner*—Prabodh Dharia
(74) *Attorney, Agent, or Firm*—H.C. Park & Associates, PLC

(57) ABSTRACT

An image data correction method and apparatus for a plasma display panel, and a plasma display panel device having the apparatus. The image data correction method calculates a load factor of video signals fed into a plasma display panel, and determines an automatic power control level corresponding to the calculated load factor. The method further involves generating sustain pulse information and the number of subfields and selecting a correction table corresponding to the number of subfields and the automatic power control level from the memory. Then, the image data is corrected with reference to the correction table. By this image data correction, white chromaticity can be maintained constantly while enhancing the color reproducibility of each subfield.

10 Claims, 5 Drawing Sheets

IMAGE DATA CORRECTION METHOD AND APPARATUS FOR PLASMA DISPLAY PANEL, AND PLASMA DISPLAY PANEL DEVICE HAVING THE APPARATUS

CROSS REFERENCE TO RELATED APPLICATION

This application claims priority to and the benefit of Korean Patent Application No. 2003-10999 filed on Feb. 21, 2003 in the Korean Intellectual Property Office, the content of which is incorporated herein by reference in its entirety.

BACKGROUND OF THE INVENTION (a) Field of the Invention

The invention relates to a plasma display panel device. More specifically, the invention relates to an image data correction method and apparatus for amending image data while maintaining chromaticity of video signals and constant white linearity, and a plasma display panel device having the apparatus.

(b) Description of the Related Art

The plasma display panel is a display device that has a plurality of discharge cells arranged in a matrix form, which are selectively excited to emit light and thereby to reconstitute image data originally input as electrical signals.

Gray-scale representation must be achieved on the PDP for improved performance of the PDP as a color display device. A gray-scale representation method divides one field into a plurality of subfields and subjects the subfields to time division control to achieve gray-scale representation by the subfields.

The number of subfields is fixed irrespective of image data in a general gray-scale representation method. However, a gray-scale representation method using a variable subfield method determines the number of subfields according to the average signal level (hereinafter, referred to as "ASL") of 1-field image signals, and maps input image data in a memory according to the number of subfields.

Gamma correction and error propagation processing are performed on the input image signals. Namely, digital image data undergo gamma-value correction based on the characteristics of the PDP, and at the same time, display errors undergo propagation processing for the surrounding pixels.

Now, the prior art will be described with reference to an accompanying drawing.

FIG. 1A shows a comparison of the weights of a red fluorescent body with application of image gamma between the cases where the number of subfields is 10 and where the number of subfields is 12. FIG. 1B shows a comparison of the weights of a red fluorescent body without application of image gamma between the cases where the number of subfields is 10 and where the number of subfields is 12.

Referring to FIGS. 1A and 1B, the luminescence characteristic of the fluorescent body differs by APC (Automatic Power Control) levels according to the number of subfields.

Conventionally, the luminescence characteristic of RGB varying by subfields is not reflected on the gamma correction, and accordingly, image data are falsely corrected.

SUMMARY OF THE INVENTION

The invention at least solves the problems with the prior art, and provides an image data correction method and apparatus that generates correction data by APC levels according to the number of subfields and uses them to correct image data, and a PDP device having the apparatus.

In one aspect of the invention, there is provided an image data correction method for a plasma display panel, which includes a plurality of address electrodes, and a plurality of scan and sustain electrodes arranged alternately and in pairs, the image data correction method including: (a) calculating a load factor of video signals; (b) determining an automatic power control level corresponding to the load factor, and generating sustain pulse information and the number of subfields; and (c) selecting a correction table from a memory according to the number of subfields and the automatic power control level, and correcting image data.

In another aspect of the invention, there is provided an image data correction apparatus for a plasma display panel, which includes a plurality of address electrodes, and a plurality of scan and sustain electrodes arranged alternately and in pairs, the image data correction apparatus including: an average signal level calculator for calculating an average signal level of externally input video signals to output a load factor; an automatic power controller generating sustain pulse information and the number of subfields corresponding to the load factor; a subfield generator for generating subfield data corresponding to each image data of as many as the number of subfields output from the automatic power controller; and an image data corrector for receiving the number of subfields fed back from the automatic power controller, correcting image data with reference to a correction table corresponding to the number of subfields, and outputting the corrected image data to the automatic power controller.

In another aspect of the invention, there is provided a plasma display panel device including: a plasma display panel including a plurality of address electrodes, and a plurality of scan and sustain electrodes arranged alternately and in pairs; a controller for calculating a load factor of externally input video signals, generating sustain pulse information and the number of subfields corresponding to the load factor, and selecting a correction table corresponding to the number of subfields to output data of the corrected video signals; an address data generator for generating address data corresponding to the correction data output from the controller, and applying them to the address electrodes of the plasma display panel; and a sustain/scan pulse generator for generating sustain/scan pulses corresponding to the sustain pulse information output from the controller, and applying them to the sustain/scan electrodes.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF EXEMPLARY EMBODIMENTS OF THE INVENTION

In the following detailed description, only exemplary embodiments of the invention have been shown and described, simply by way of illustration of the best mode contemplated by the inventor of carrying out the invention. As will be realized, the invention is capable of modification in various obvious respects, all without departing from the invention. Accordingly, the drawings and description are to be regarded as illustrative in nature, and not restrictive.

Figure 1A:
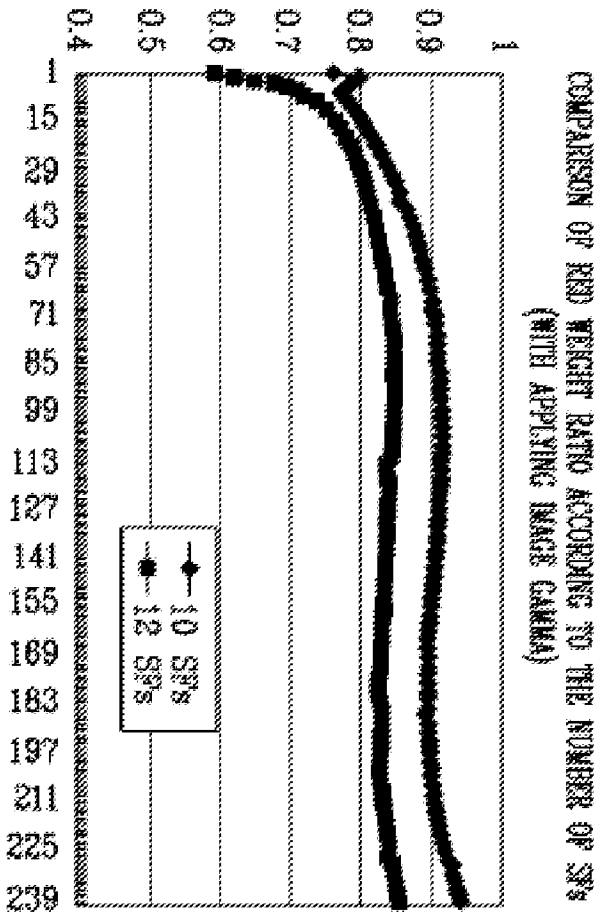
FIG. 1A(Prior Art)
FIG. 1A shows a comparison of the weights of a red fluorescent body with application of image gamma data between the cases where the number of subfields is 10 and where the number of subfields is 12.
Figure 1B:
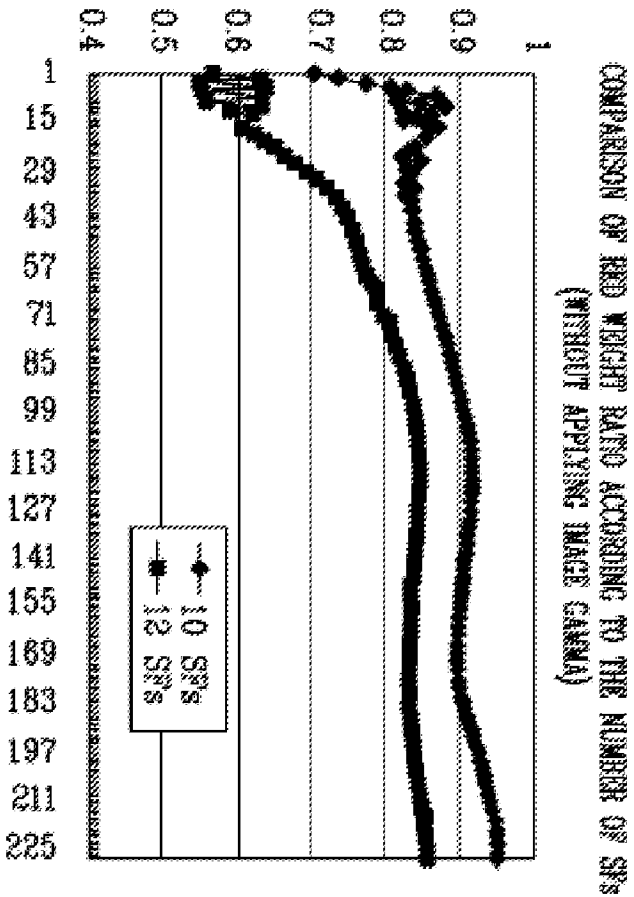
FIG. 1B(Prior Art)
FIG. 1B shows a comparison of the weights of a red fluorescent body without application of image gamma data between the cases where the number of subfields is 10 and where the number of subfields is 12.
Figure 2:
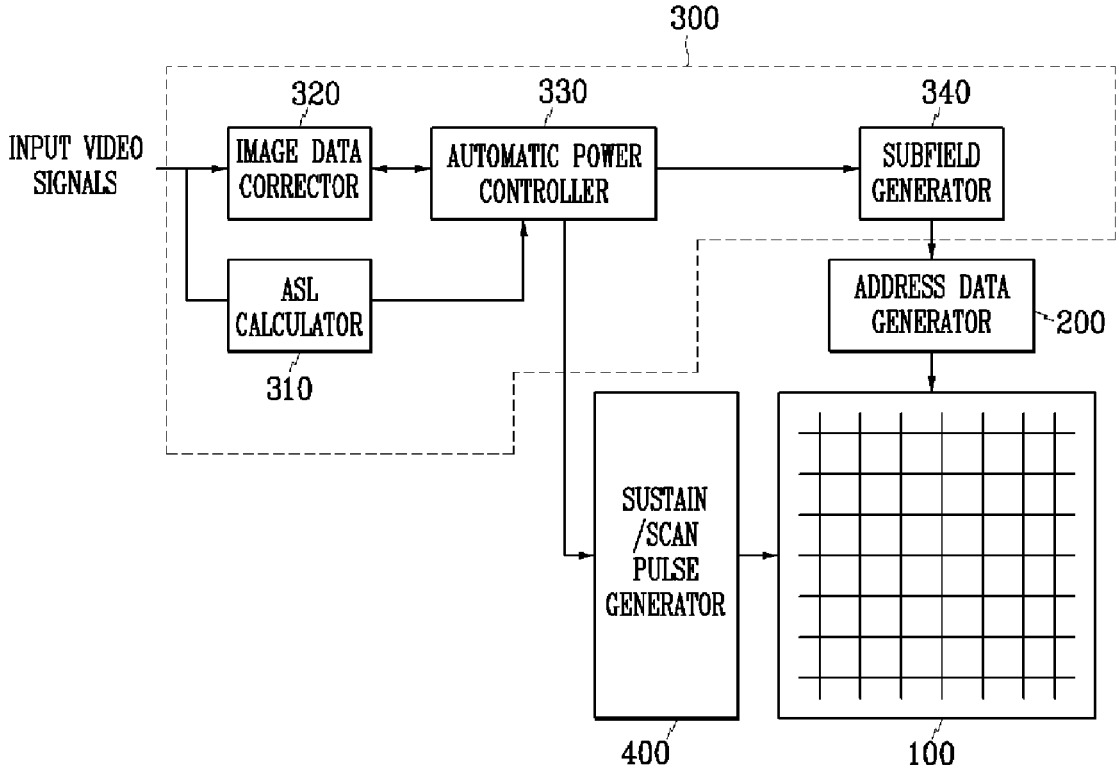
FIG. 2 shows a schematic of a PDP device according to an exemplary embodiment of the invention.

FIG. 2 shows a schematic of a PDP device according to an exemplary embodiment of the invention.

Referring to FIG. 2, the PDP device according to the embodiment of the invention comprises a PDP 100, an address data generator 200, a controller 300, and a sustain/scan pulse generator 400.

The PDP 100 comprises a plurality of address electrodes, and a plurality of scan and sustain electrodes arranged alternately and in pairs.

The controller 300 calculates the load factor of external video signals, generates sustain pulse information and the number of subfields for the load factor, determines a correction table corresponding to the number of subfields, and corrects the video signals. The address data generator 200 generates address data corresponding to the correction data output from the controller 300, and applies them to the address electrodes of the PDP 100.

The sustain/scan pulse generator 400 generates sustain/scan pulses according to the sustain information from the controller 300, and applies them to the sustain/scan electrodes.

The controller 300 comprises an ASL calculator 310, an image data corrector 320, an automatic power controller 330, and a subfield generator 340. The ASL calculator 310 measures the load factor of externally input video signals. The image data corrector 320 receives the number of subfields fed back from the automatic power controller 330, corrects the image data with reference to a correction table corresponding to the number of subfields, and outputs the corrected image data to the automatic power controller 330. The automatic power controller 330 outputs sustain/scan pulse information and the number of subfields corresponding to the load factor. The subfield generator 340 generates subfield data corresponding to each image data for the number of subfields output from the automatic power controller 330.

Figure 3:
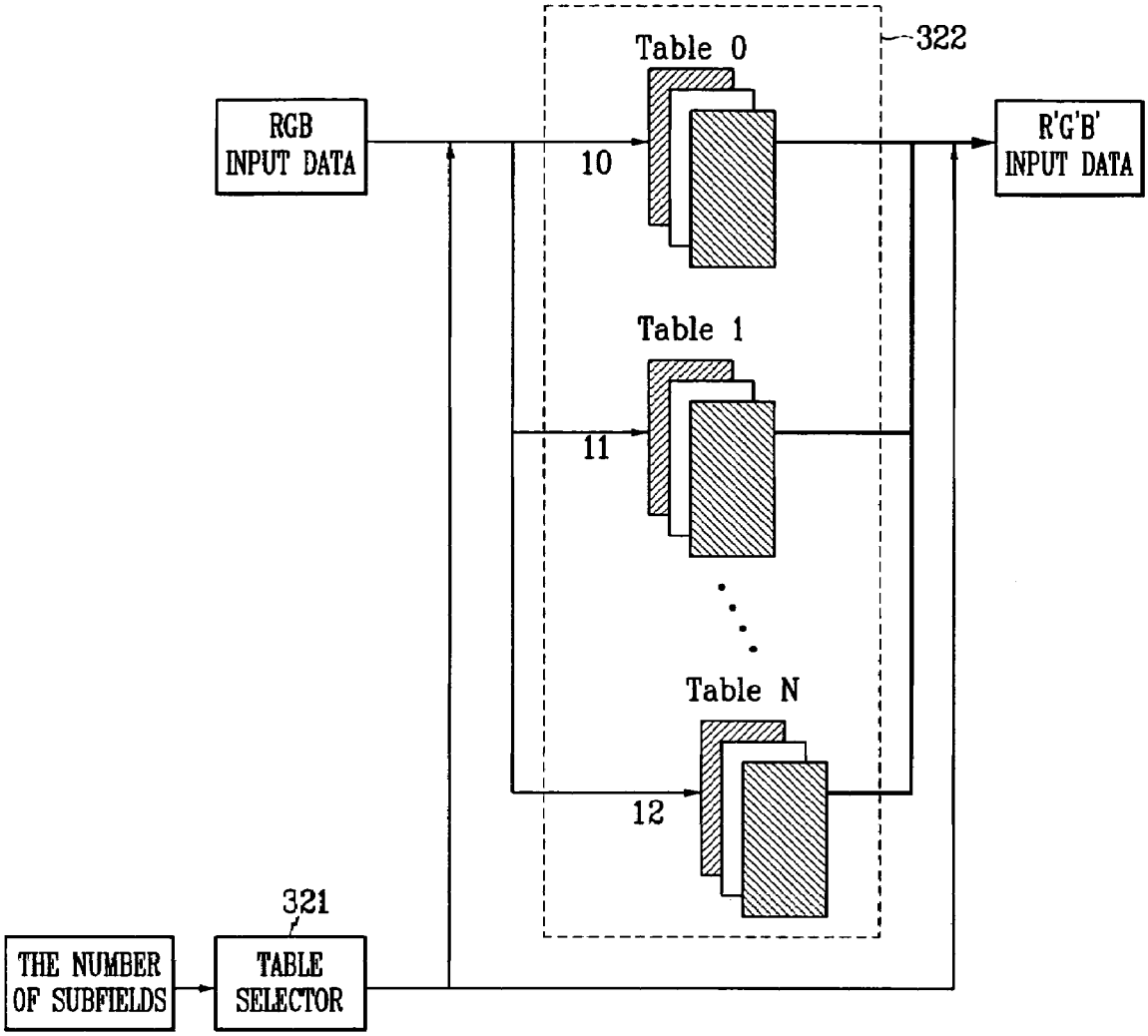
FIG. 3 shows a first exemplary embodiment of the image data corrector shown in FIG. 2.

FIG. 3 is a detailed diagram of a first exemplary embodiment of the image data corrector of FIG. 2.

Referring to FIG. 3, the image data corrector 320 comprises a table selector 321, and a memory 322. The memory 322 stores correction data for gray scale data by subfields. The table selector 321 selects a correction table according to the number of subfields to output image data with reference to the correction table.

Next, a detailed description of the operation of the image data correction method and apparatus for PDPs will be given. A detailed description of a PDP device having the apparatus according to the exemplary embodiment of the invention as constructed above will also be given below.

The ASL calculator 310 receives the external video signals and calculates the ASL (i.e., the load factor) of the video signals.

The image data corrector 320 corrects the video signals and outputs the corrected image data. If necessary, the image data corrector 320 corrects the gamma value of the image data according to the characteristics of the PDP 100, and at the same time, performs propagation processing of display errors for the surrounding pixels. In particular, for example, the image data corrector 320 uses the number of subfields fed from the automatic power controller 330 to correct the image data with reference to a correction table corresponding to the number of subfields and outputs the corrected image data to the automatic power controller 330.

Accordingly, the automatic power controller 330 determines the number of subfields based on the load factor and outputs the number of subfields to the image data corrector 320. The automatic power controller 330 also generates sustain pulse information based on the load factor, and transfers the corrected image data from the image data corrector 320 to the subfield generator 340.

The subfield generator 340 generates subfield data corresponding to the corrected image data for the number of subfields output from the automatic power controller 330.

The address data generator 200 generates address data corresponding to the subfield data output from the subfield generator 340, and applies the address data to the address electrodes of the PDP 100.

The sustain/scan pulse generator 400 receives the sustain pulse information from the automatic power controller 330, generates sustain/scan pulses according to the sustain pulse information, and applies the sustain/scan pulses to the sustain/scan electrodes of the PDP 100.

The image data is then displayed on the PDP 100.

The role of the image data corrector 320 in this process can be described in further detail as follows. Referring to FIG. 3, the automatic power controller 330 feeds the number of subfields back to the table selector 321. Then, the table selector 321 outputs gray scale data R'G'B' for the corrected image data RGB with reference to the correction table corresponding to the number of subfields.

There are correction tables based on the number of subfields, which store the most adequate values calculated by experiments. Each table includes gray scale data and corrected image data corresponding to the gray scale data. Namely, there are tables presenting the corrected gray scale values corresponding to the input gray scale values for R, G, and B.

Accordingly, the corrected values for input image data can be output differently according to the number of subfields to constantly maintain white chromaticity and to enhance the color reproducibility of each subfield.

This image data correction method may have various modifications, an example of which will be described as follows in terms of a second embodiment of the invention that generates a correction table according to the number of subfields and the APC level to maintain the chromaticity more precisely and constantly.

Figure 4:
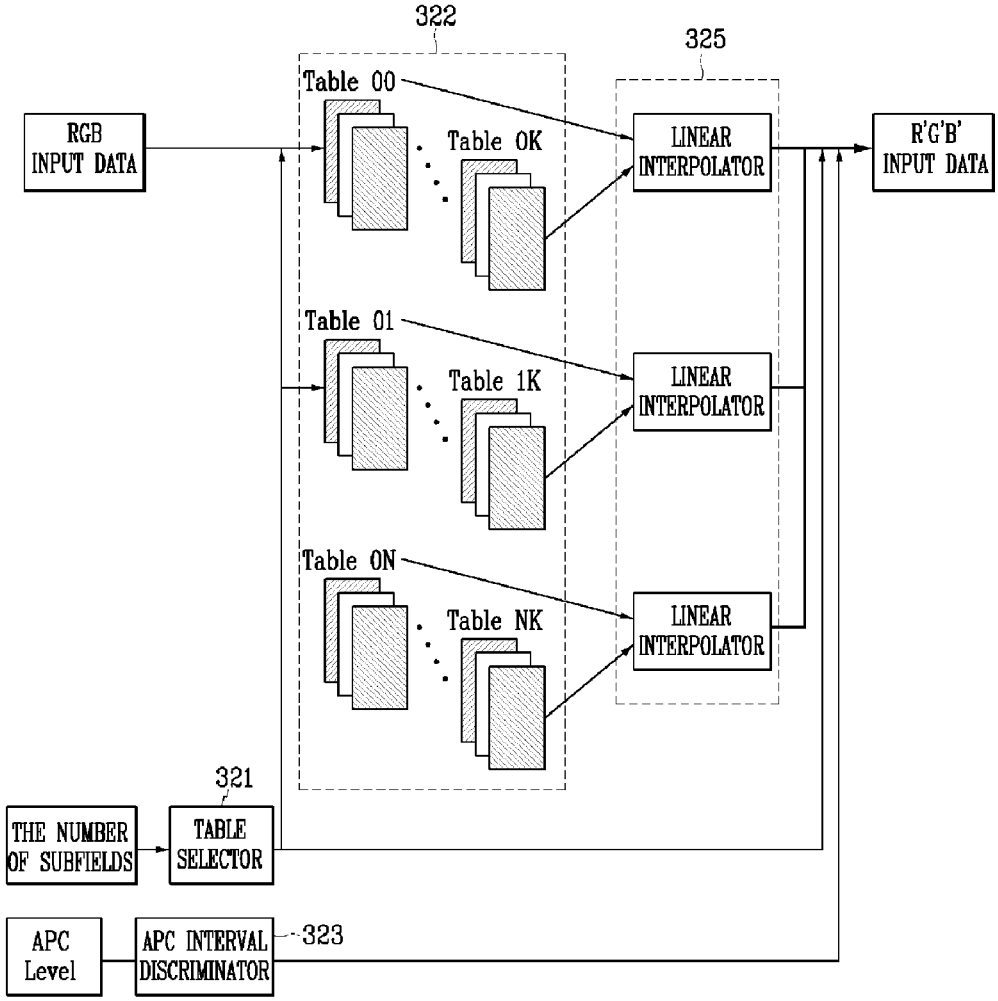
FIG. 4 shows a second exemplary embodiment of the image data corrector shown in FIG. 2.

FIG. 4 is a schematic of an image data corrector according to the second embodiment of the invention. Referring to FIG. 4, the image data corrector 320 according to the second embodiment of the invention comprises a table selector 321, an APC interval discriminator 323, a linear interpolator 325, and a memory 322.

The memory 322 stores correction data for gray scale data for a defined number of APC levels based on subfields. The table selector 321 selects a table corresponding to the image data according to the number of subfields.

The APC interval discriminator 323 determines an interval corresponding to the APC level, and selects two correction tables including the corresponding interval. The linear interpolator 325 calculates correction data for the corresponding APC level belonging to the interval through a linear interpolation operation from the two correction tables that form one interval. This will be described as follows with reference to FIG. 5.

Figure 5:
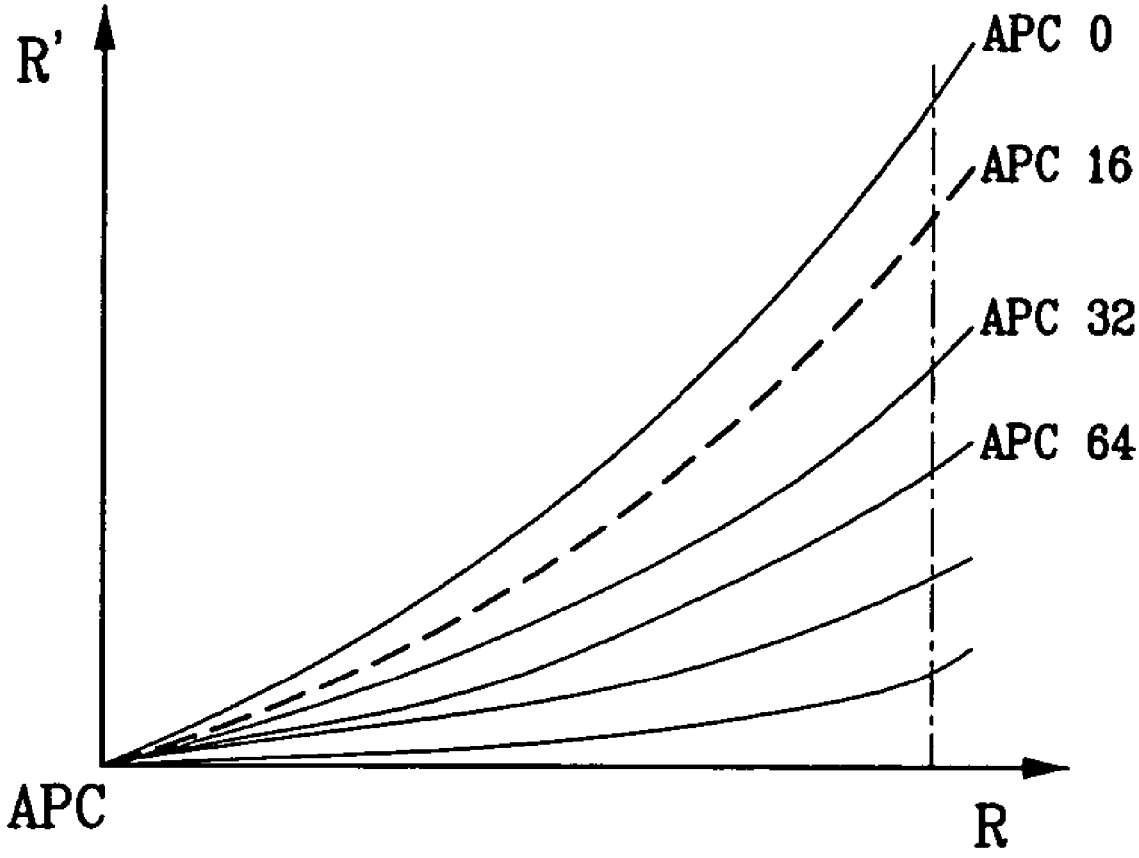
FIG. 5 shows a linear interpolation operation.

FIG. 5 is a conceptual diagram of linear interpolation. Referring to FIG. 5, the linear interpolator 325 uses, for example, correction data of APC levels 32 and 0 to calculate correction data of APC level 16. Namely, ½ can be applied because APC level 16 is an intermediate between APC levels 32 and 0. If the APC level is not an intermediate, an appropriate proportion can be applied. This linear interpolation operation is well known to those skilled in the art.

By using the linear interpolation operation, any correction data corresponding to the APC level of all the intervals can be generated with a small memory capacity. If necessary, the experimental results for the APC levels of all the intervals can be stored as correction tables in a memory without using the linear interpolation operation.

In various exemplary embodiments of the invention, the correction tables stored in the memory contain the most adequate values as determined by experiments. The number of correction tables necessary may be determined as shown in the following example.

When using 5 correction tables for each APC level with 10 to 12 subfields, for example, the required number of correction tables is 15 in total.

APC 00~APC 29: SF 10→correction table 00~correction table 04

APC 30~APC 62: SF 11→correction table 10~correction table 14

APC 63~APC 127: SF 12→correction table 20~correction table 24

Here, the correction table of subfield 12 is divided into 4 intervals by 5 correction tables as follows.

Interval 0→APC 63~APC 78:→correction table 20~correction table 21

Interval 1→APC 79~APC 94:→correction table 21~correction table 22

Interval 2→APC 95~APC 110:→correction table 22~correction table 23

Interval 3→APC 111~APC 127:→correction table 23~correction table 24

When the number of subfields is 12 and the APC level is 100, this correction table belongs to interval 2 of subfield 12 and correction data is output from the correction data of tables 22 and 23 by linear interpolation. Each correction table stores corrected gray scale data for each RGB gray scale data obtained by experiments.

The number of correction tables is variable depending on the user's needs and can be adequately designed in consideration of the capacity of the memory.

While this invention has been described in connection with what is presently considered to be the most practical embodiment, it is to be understood that the invention is not limited to the disclosed embodiments, but, on the contrary, is intended to cover various modifications and equivalent arrangements included within the spirit and scope of the appended claims.

As described above, the exemplary embodiment of the invention generates a correction table corresponding to the number of subfields and the APC level and corrects input image data according to the correction table to maintain constant white chromaticity and enhance the color reproducibility of each subfield.

What is claimed is:

1. An image data correction method for a plasma display panel, which includes a plurality of address electrodes, and a plurality of scan and sustain electrodes arranged alternately and in pairs, the image data correction method comprising:

(a) calculating a load factor of video signals;

(b) determining an automatic power control level corresponding to the load factor, and generating sustain pulse information and the number of subfields; and (c) selecting a correction table from a memory according to the number of subfields and the automatic power control level, and correcting image data.

2. The image data correction method as claimed in claim 1, wherein the step (c) comprises outputting correction data from two correction tables constituting an interval including the automatic power control level of input image data by linear interpolation.

3. The image data correction method as claimed in claim 1, wherein the correction data is based on stored experimental data.

4. An image data correction apparatus for a plasma display panel, which includes a plurality of address electrodes, and a plurality of scan and sustain electrodes arranged alternately and in pairs, the image data correction apparatus comprising:

an average signal level calculator for calculating an average signal level of externally input video signals to output a load factor;

an automatic power controller generating sustain pulse information and the number of subfields corresponding to the load factor;

a subfield generator for generating subfield data corresponding to each image data for each of the number of subfields output from the automatic power controller; and an image data corrector for receiving the number of subfields fed back from the automatic power controller, correcting image data with reference to a correction table corresponding to the number of subfields, and outputting the corrected image data to the automatic power controller.

5. The image data correction apparatus as claimed in claim 4, wherein the image data corrector comprises:

a memory for storing correction data for gray scale data of the video signals based on subfields; and a table selector for selecting a correction table to output correction data for the input image data with reference to the correction table.

6. The image data correction apparatus as claimed in claim 4, wherein the image data corrector comprises:

a memory for storing a defined number of correction tables storing correction data for gray scale data of an automatic power control level, wherein a defined number of automatic power control levels are present for each subfield;

a table selector which selects a group of correction tables corresponding to the input image data according to the number of subfields;

an automatic power control interval discriminator which determines an interval corresponding to the automatic power control level from the selected group of correction tables, and-selecting two correction tables including the corresponding interval; and a linear interpolator which calculates correction data for the corresponding image gray scale data included in the interval by a linear interpolation operation from the two correction tables forming one interval determined by the automatic power control interval discriminator.

7. A plasma display panel device comprising:

a plasma display panel including a plurality of address electrodes, and a plurality of scan and sustain electrodes arranged alternately and in pairs;

a controller for calculating a load factor of externally input video signals, generating sustain pulse information and a number of subfields corresponding to the load factor, and selecting a correction table corresponding to the number of subfields to output corrected video signals data;

an address data generator which generates address data corresponding to the corrected data output from the controller, and applying the generated address data to the address electrodes of the plasma display panel; and a sustain/scan pulse generator which generates sustain/scan pulses corresponding to the sustain pulse information output from the controller, and applying the generated sustain/scan pulses to the sustain/scan electrodes.

8. The plasma display panel device as claimed in claim 7, wherein the controller comprises:

an average signal level calculator which calculates an average signal level of externally input video signals to output a load factor;

an automatic power controller which generates sustain pulse information and the number of subfields corresponding to the load factor;

a subfield generator which generates subfield data corresponding to each image data for the number of subfields output from the automatic power controller; and an image data corrector for receiving the number of subfields from the automatic power controller, correcting image data with reference to a correction table corresponding to the number of subfields, and outputting the corrected image data to the automatic power controller.

9. The plasma display panel device as claimed in claim 8, wherein the image data corrector comprises:

a memory for storing correction data for gray scale data of the video signals by subfields; and a table selector for selecting a correction table to output correction data for the input image data with reference to the correction table.

10. The plasma display panel device as claimed in claim 8, wherein the image data corrector comprises:

a memory for storing a defined number of correction tables storing correction data for gray scale data of an automatic power control level, wherein a defined number of automatic power control levels are present for each subfield;

a table selector for selecting a group of correction tables corresponding to the input image data according to the number of subfields;

an automatic power control interval discriminator for determining an interval corresponding to the automatic power control level from the selected group of correction tables, and selecting two correction tables including the corresponding interval; and a linear interpolator which calculates correction data for the corresponding image gray scale data included in the interval by a linear interpolation operation from the two correction tables forming one interval determined by the automatic power control interval discriminator.

* * * * *